US007284952B2

(12) United States Patent
Huang et al.

(10) Patent No.: US 7,284,952 B2
(45) Date of Patent: Oct. 23, 2007

(54) CENTRIFUGAL FAN

(75) Inventors: Yu-Nien Huang, Chungli (TW); Cheng-Yu Wang, Hsinchu (TW); Shun-Ta Yu, Taipei (TW)

(73) Assignee: Quanta Computer Inc., Tao Yuan Shien (TW)

( * ) Notice: Subject to any disclaimer, the term of this patent is extended or adjusted under 35 U.S.C. 154(b) by 281 days.

(21) Appl. No.: 11/044,012

(22) Filed: Jan. 28, 2005

(65) Prior Publication Data

US 2005/0214114 A1 Sep. 29, 2005

(30) Foreign Application Priority Data

Mar. 25, 2004 (TW) ..... 93108186 A

(51) Int. Cl.
*F01D 25/04* (2006.01)

(52) U.S. Cl. ..... 415/119; 415/206

(58) Field of Classification Search ..... 415/119, 415/204, 206
See application file for complete search history.

(56) References Cited

U.S. PATENT DOCUMENTS 6,254,336 B1 * 7/2001 Ahn ..... 415/119
6,379,111 B1 * 4/2002 Katoh et al. ..... 415/119
6,767,184 B2 * 7/2004 Kim et al. ..... 415/204
6,953,319 B2 * 10/2005 Sohn et al. ..... 415/119
7,144,219 B2 * 12/2006 Hancock ..... 415/212.1

* cited by examiner

*Primary Examiner*—Edward K. Look
*Assistant Examiner*—Devin Hanan
(74) *Attorney, Agent, or Firm*—Rabin & Berdo, PC

(57) ABSTRACT

A centrifugal fan is described. The centrifugal fan is suitable for a portable electrical apparatus. A tongue shape is formed from a volute sidewall of a casing of the centrifugal fan and non-parallel to a rotational axis of blades. Therefore, when the blades rotate to generate a wake flow to blow on a surface of the volute sidewall at the tongue shape, noise generated by the centrifugal fan can be decreased.

15 Claims, 3 Drawing Sheets

CENTRIFUGAL FAN

CROSS-REFERENCE TO RELATED APPLICATION

This application claims the priority benefit of Taiwan application serial no. 93108186, filed Mar. 25, 2004, the full disclosure of which is incorporated herein by reference.

FIELD OF THE INVENTION

The present invention relates to a centrifugal fan, and more particularly, to a centrifugal fan with a surface of a volute sidewall at a tongue shape non-parallel to a rotational axis of blades.

BACKGROUND OF THE INVENTION

A heat dissipation module is necessary to provide effective heat dissipation for a portable electrical apparatus, and especially for a notebook personal computer (PC), so as to allow the best performance. When heat accumulates and cannot dissipate in the apparatus, the electrical devices and the apparatus as a whole cannot work normally. Seriously, the computer system, in particular, will crash. However, in order to satisfy the market requirement for mobilization, sufficient space has not been left in the casing of the notebook PC for natural convection. Because heat dissipation design for high-frequency devices is at a bottleneck, the heat dissipation module of the notebook PC tends to dissipate heat with forced convection generated by a centrifugal fan.

Reference is made to FIG. 1, which depicts a three-dimensional structure showing a centrifugal fan of the prior art. The centrifugal fan 10, installed in a portable electrical apparatus such as a notebook PC, comprises a casing 11 and blades 31. The casing 11 has a volute sidewall 13 and a bottom plate 15, and the casing 11 defines a cavity 17 and an outlet 19. A volute channel 21 is formed from the cavity 17 and the outlet 19, and a tongue shape 23 is formed from the volute sidewall 13 on a side of the outlet 19. The elongate axis of each blade 31 is vertically with a rotational axis 33 on the bottom plate 15 in the cavity 17, and the surface of each blade 31 is parallel to the rotational axis 33. Rotation of blades 31 drives a horizontal airflow 25. The horizontal airflow 25 can be exhausted via dynamic and static pressures generated by the horizontal airflow 25 passing through the volute channel 21. The outlet 19 of the prior art uses a curved surface and divergent duct with a constant section, which means a surface 16 of the volute sidewall 13 at the tongue shape 23 is parallel to the rotational axis 33; in other words, an angle of the surface 16 is 90 degrees relative to the bottom plate 15. This makes the air flow generate dynamic and static pressure, and the air resists outside force to achieve the effect of heat dissipation.

Reference is made to FIG. 2, which depicts a schematic diagram showing a wake flow generated by the centrifugal fan of the prior art blowing on the volute sidewall at the tongue shape. When the wake flow 35 generated by the blades 31 is blowing on the surface 16 of the volute sidewall 13 at the tongue shape 23, each blasting point 41 is generated and regarded as a sound source that generates narrow band noise 43. Because the surface 16 of the volute sidewall 13 at the tongue shape 23 is parallel to the rotational axis 33, according to the superposition principle, the narrow band noise 43 with large amplitude 45 and constant blade pass frequency will be generated. Once it is necessary to enhance the efficiency of the heat dissipation, the flow rate and the wind velocity must be increased. However, the more the rotational speed and the flow rate are increased, the higher the frequency of the noise band is. Therefore, the noise is increasing.

SUMMARY OF THE INVENTION

It is an aspect of the present invention to provide a centrifugal fan suitable for a portable electrical apparatus. A tongue shape is formed from the volute sidewall of a casing of the centrifugal fan, and a surface of the volute sidewall at the tongue shape is curved and non-parallel to a rotational axis of blades. Therefore, when the blades rotate to generate a wake flow to blow the surface of the volute sidewall at the tongue shape, noise generated by the centrifugal fan can be decreased.

According to the aforementioned aspect of the present invention, a color filter of a centrifugal fan is provided, which is suitable for a portable electrical apparatus and comprises a casing having a bottom plate and a volute sidewall disposed on the bottom plate to define a cavity and an outlet. A tongue shape is formed from the volute sidewall on at least one side of the outlet; and blades are disposed vertically with a rotational axis on the bottom plate of the cavity. The volute sidewall at the tongue shape is non-parallel to the rotational axis of the blades.

In a preferred embodiment of the present invention, the aforementioned portable electrical apparatus is a notebook PC.

In a preferred embodiment of the present invention, a surface of the aforementioned volute sidewall at the tongue shape is, for example, concave, convex, ramped, or a combination of these configurations.

The surface of the volute sidewall at the tongue shape of the centrifugal fan of the invention is curved and non-parallel to the rotational axis of the blades, resulting in easy manufacture and improvement of the issue of noise caused by the centrifugal fan.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
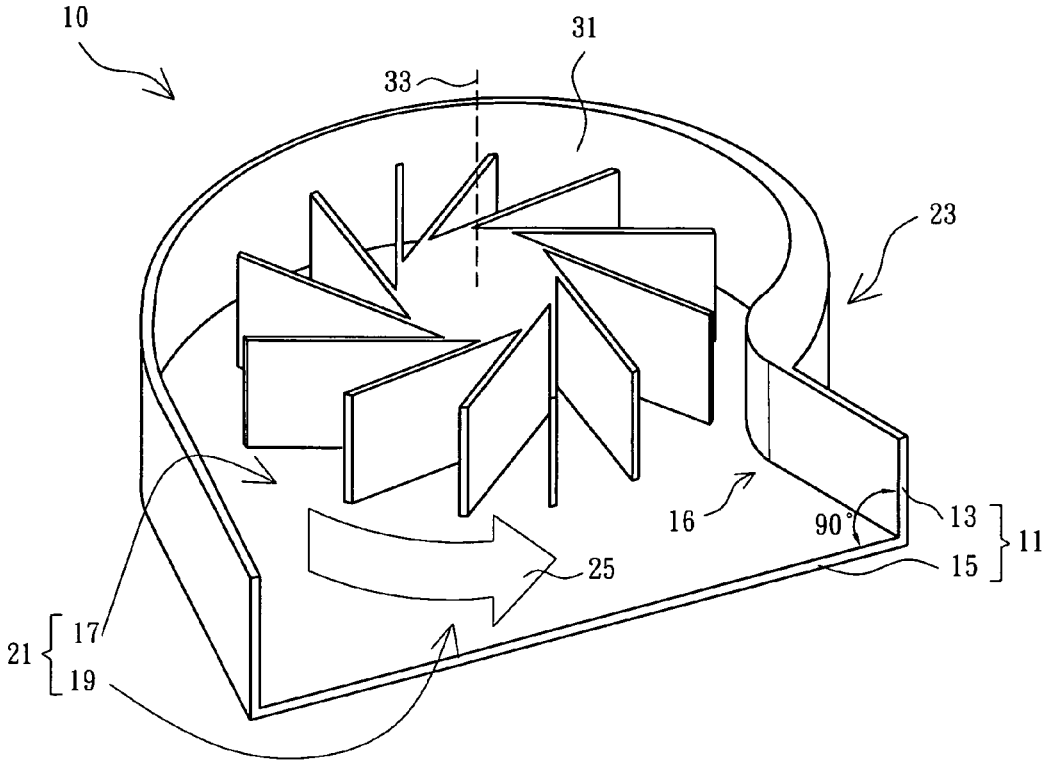
Fig. 1 (Prior Art)
FIG. 1 depicts a three-dimensional structure showing a centrifugal fan of the prior art.
Figure 2:
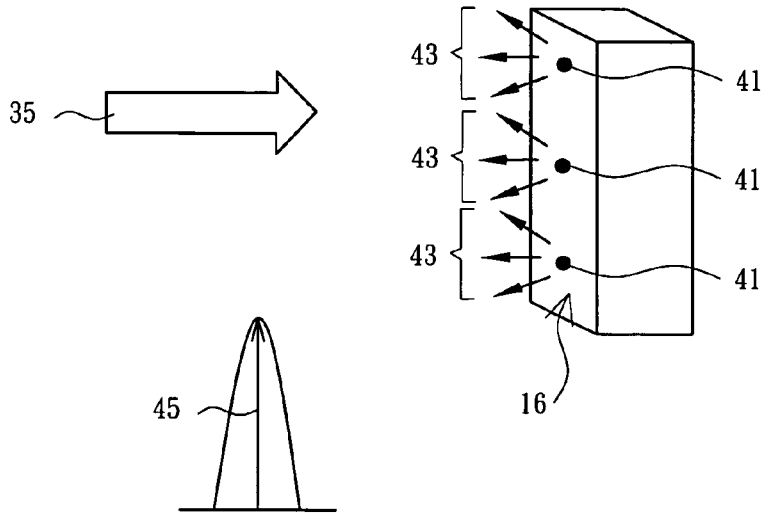
Fig. 2 (Prior Art)
FIG. 2 depicts a schematic diagram showing a wake flow generated by the centrifugal fan of the prior art blowing on the volute sidewall at the tongue shape.
Figure 3:
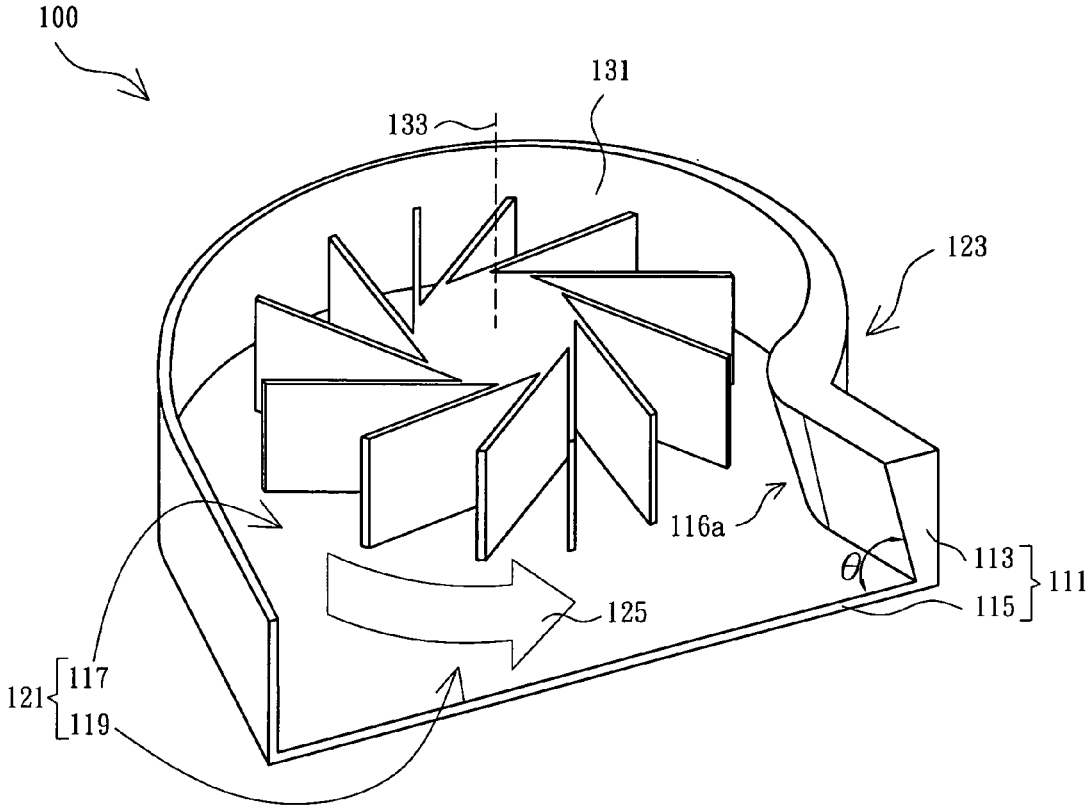
FIG. 3 depicts a three-dimensional structure showing a centrifugal fan in accordance with a preferred embodiment of the present invention.

Reference is made to FIG. 3, which depicts a three-dimensional structure showing a centrifugal fan in accordance with a preferred embodiment of the present invention. The centrifugal fan 100 installed in a portable electrical apparatus such as a notebook PC, comprises a casing 111 and blades 131. The casing 111 has a volute sidewall 113 and a bottom plate 115, and the casing 111 defines a cavity 117 and an outlet 119. A volute channel 121 is formed from the cavity 117 and the outlet 119, and a tongue shape 123 is formed from the volute sidewall 113 on a side of the outlet 119. The elongate axis of each blade 131 is vertically with a rotational axis 133 on the bottom plate 115 in the cavity 117, and preferably, the blades 131 are disposed vertically to the bottom plate 115. Rotation of the blades 131 drives a horizontal airflow 125. The horizontal airflow 125 can be exhausted via dynamic and static pressure generated by the horizontal airflow 125 passing through the volute channel 121. Meanwhile, when horizontal airflow 125 is generated by the blades 131 rotating, the blades 131 blow on a surface 116*a* of the volute sidewall 113 at the tongue shape 123; the outlet 119 of the present invention uses a curved surface and divergent duct with a variable section, and a surface 116*a* of the volute sidewall 113 at the tongue shape 123 is non-parallel to the rotational axis 133. The outlet 119 is broadened and noise generated by the centrifugal fan can be decreased.

Figure 4:
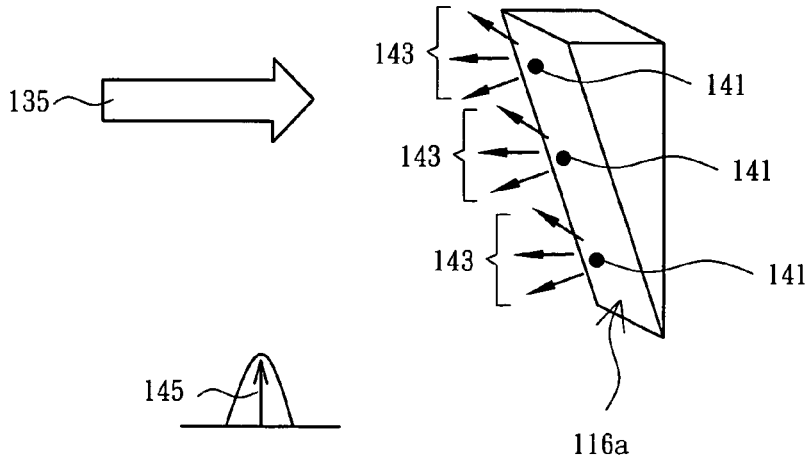
FIG. 4 depicts a schematic diagram showing a wake flow generated by the centrifugal fan in accordance with a preferred embodiment of the present invention blowing on the volute sidewall at the tongue shape.

Reference is made to FIG. 4, which depicts a schematic diagram showing a wake flow generated by the centrifugal fan in accordance with a preferred embodiment of the present invention blowing on the volute sidewall at the tongue shape. When the wake flow 135 generated by the blades 131 is blowing on the surface 116*a* of the volute sidewall 113 at the tongue shape 123, each blasting point 141 is generated and regarded as a sound source that generates narrow band noise 143. Because the surface 116*a* of the volute sidewall 113 at the tongue shape 123 is non-parallel to the rotational axis 133, the time at which each sound source is generated is different. Therefore, the amplitude 145 can be substantially decreased as a result of less constructive interference of sound waves generated by the sound sources on different time; that is to say, the narrow band noise 143 is lessened.

Figure 5:
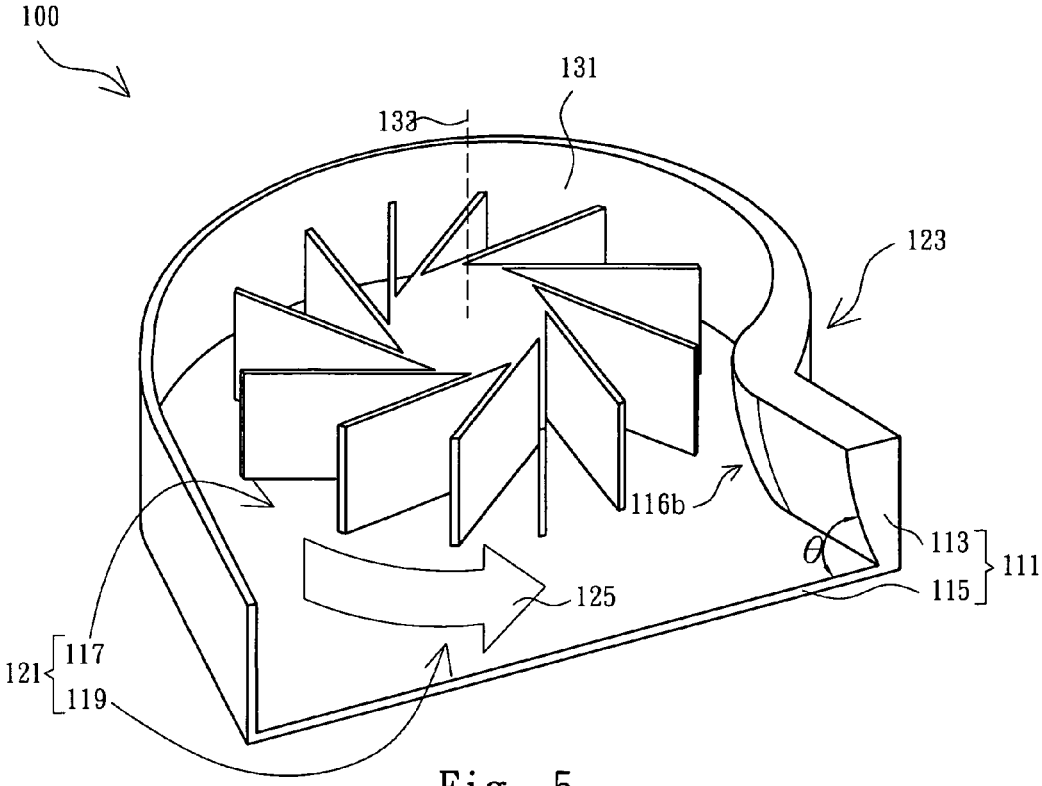
FIG. 5 depicts a three-dimensional structure showing a centrifugal fan in accordance with another preferred embodiment of the present invention.
Figure 6:
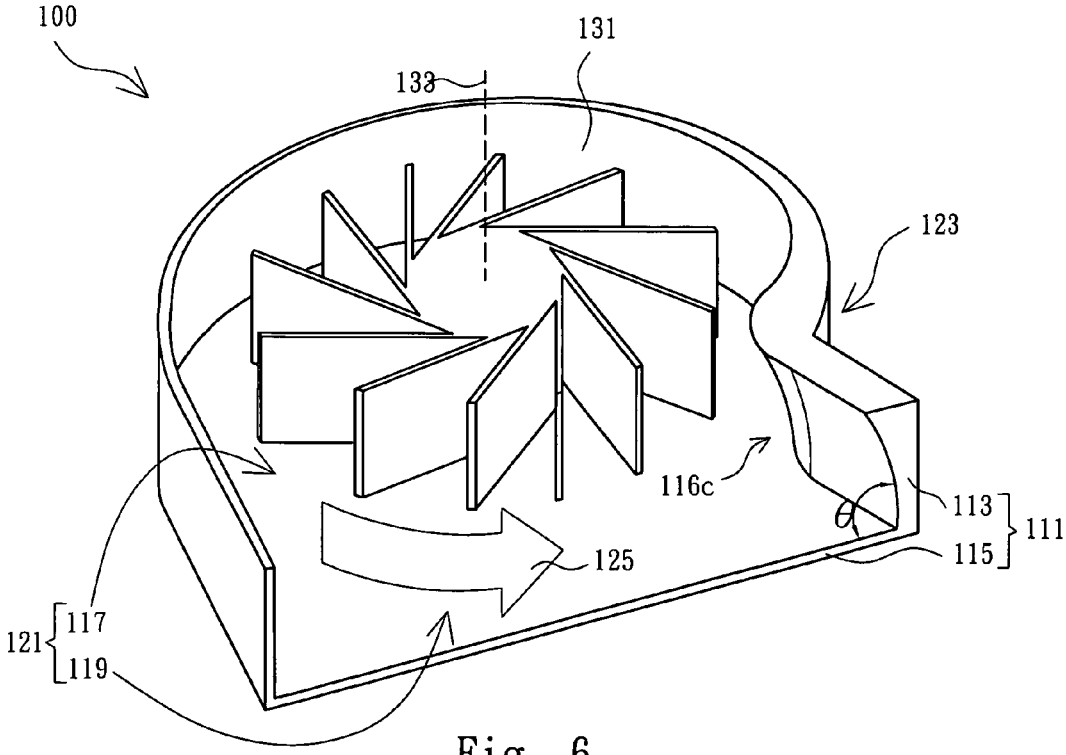
FIG. 6 depicts a three-dimensional structure showing a centrifugal fan in accordance with still another preferred embodiment of the present invention.

It is worth mentioning that the surface of the volute sidewall of the present invention, compared with that of the prior art, is non-vertical to the bottom plate. For example, reference is made to FIG. 4 again; the surface 116*a* is an angle θ relative to the bottom plate. The angle θ may be more than 0 and less than 90 degrees, or more than 90 and less than 180 degrees. In addition, the surface 116*a* of the volute sidewall 113 at the tongue shape 123 is also designed to be a curved surface, for example, a concave, convex or ramped surface, or a surface combining these configurations. Reference is made to FIG. 3 again, which depicts a three-dimensional structure showing a centrifugal fan in accordance with a preferred embodiment of the present invention. The surface 116*a* is ramped. Reference is made to FIG. 5, which depicts a three-dimensional structure showing a centrifugal fan in accordance with another preferred embodiment of the present invention; the surface 116*b* is concave. Reference is made to FIG. 6, which depicts a three-dimensional structure showing a centrifugal fan in accordance with still another preferred embodiment of the present invention; the surface 116*c* is convex. However, a person skilled in the art can understand that the present invention can be embodied by adjusting the angle between the aforementioned surface and the bottom plate, or constructing the surface from various types of surfaces, if necessary, and thus further details do not need to be given herein.

As mentioned above, the surface of the volute sidewall 113 at the tongue shape 123 can effectively reduce the amplitude 145 of the noise and broaden the outlet 119, as well as decrease various distribution of the wake flow 135 after the wake flow 135 blows. Hence, the broader band noise is obtained to allow a user to experience a better quality of sound.

Therefore, according to the aforementioned preferred embodiments, one advantage of the centrifugal fan of the present invention is that the surface of the volute sidewall at the tongue shape of the centrifugal fan is curved and non-parallel to the rotational axis of the blades. Therefore, when the blades rotate to generate a wake flow to blow on the surface of the volute sidewall at the tongue shape, noise generated by the centrifugal fan can be decreased.

As is understood by a person skilled in the art, the foregoing preferred embodiments of the present invention are illustrated of the present invention rather than limiting of the present invention. It is intended that various modifications and similar arrangements be included within the spirit and scope of the appended claims, the scope of which should be accorded the broadest interpretation so as to encompass all such modifications and similar structure.

What is claimed is:

1. A centrifugal fan, suitable for a portable electrical apparatus, comprising:

a casing comprising:

a bottom plate; and a volute sidewall disposed on the bottom plate to define a cavity and an outlet, wherein a tongue shape is formed from the volute sidewall on at least one side of the outlet; and blades disposed vertically with a rotational axis on the bottom plate of the cavity, wherein the casing has a curved surface and a divergent duct with a variable section at the outlet to broaden the outlet, so that an inner surface of the volute sidewall at the tongue shape is non-parallel to the rotational axis of the blades, and an angle of the inner surface relative to the bottom plate is more than 90 and less than 180 degrees; and wherein the volute sidewall at the tongue shape has a variable thickness, so that a thickness at a base thereof is different from a thickness at a top thereof.

2. The centrifugal fan according to claim 1, wherein the portable electrical apparatus is a notebook personal computer (PC).

3. The centrifugal fan according to claim 1, wherein the inner surface of the volute sidewall is concave, convex, ramped, or a combination thereof in configuration.

4. The centrifugal fan according to claim 1, wherein the inner surface of the volute sidewall is concave and ramped.

5. The centrifugal fan according to claim 1, wherein the inner surface of the volute sidewall is convex and ramped.

6. A casing of centrifugal fan, suitable for a portable electrical apparatus, comprising:

a bottom plate; and a volute sidewall disposed on the bottom plate to define a cavity and an outlet, wherein a tongue shape is formed from the volute sidewall on at least one side of the outlet, and wherein the casing has a curved surface and a divergent duct with a variable section at the outlet to broaden the outlet, so that an inner surface of the volute sidewall at the tongue shape is non-parallel to the bottom plate, and an angle of the inner surface relative to the bottom plate is more than 90 and less than 180 degrees;

wherein the volute sidewall at the tongue shape has a variable thickness, so that a thickness at a base thereof is different from a thickness at a top thereof.

7. The casing of centrifugal fan according to claim 6, wherein the portable electrical apparatus is a notebook PC.

8. The casing of centrifugal fan according to claim 6, wherein the inner surface of the volute sidewall is concave, convex, ramped, or a combination thereof in configuration.

9. The casing of centrifugal fan according to claim 6, wherein the inner surface of the volute sidewall is concave and ramped.

10. The casing of centrifugal fan according to claim 6, wherein the inner surface of the volute sidewall is convex and ramped.

11. A centrifugal fan, suitable for a portable electrical apparatus, comprising:

a casing comprising:

a bottom plate; and a volute sidewall disposed on the bottom plate to define a cavity and an outlet, wherein a tongue shape is formed from the volute sidewall on at least one side of the outlet, and the casing has a curved surface and a divergent duct with a variable section at the outlet to broaden the outlet, so that an inner surface of the volute sidewall at the tongue shape is non-vertical to the bottom plate, and an angle of the inner surface relative to the bottom plate is more than 90 and less than 180 degrees; and blades disposed vertically with a rotational axis on the bottom plate of the cavity;

wherein the volute sidewall at the tongue shape has a variable thickness, so that a thickness at a base thereof is different from a thickness at a top thereof.

12. The centrifugal fan according to claim 11, wherein the portable electrical apparatus is a notebook PC.

13. The centrifugal fan according to claim 11, wherein the inner surface of the volute sidewall is concave, convex, ramped, or a combination thereof in configuration.

14. The centrifugal fan according to claim 11, wherein the inner surface of the volute sidewall is concave and ramped.

15. The centrifugal fan according to claim 11, wherein the inner surface of the volute sidewall is convex and ramped.

* * * * *